US007274250B2

(12) United States Patent
Hazucha et al.

(10) Patent No.: US 7,274,250 B2
(45) Date of Patent: Sep. 25, 2007

(54) LOW-VOLTAGE, BUFFERED BANDGAP REFERENCE WITH SELECTABLE OUTPUT VOLTAGE

(75) Inventors: Peter Hazucha, Beaverton, OR (US); Sung T. Moon, Hillsboro, OR (US); Gerhard Schrom, Hillsboro, OR (US); Fabrice Paillet, Hillsboro, OR (US); Tanay Karnik, Portland, OR (US); Vivek De, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 79 days.

(21) Appl. No.: 11/170,559

(22) Filed: Jun. 28, 2005

(65) Prior Publication Data

US 2006/0290415 A1 Dec. 28, 2006

(51) Int. Cl.
*G05F 1/10* (2006.01)

(52) U.S. Cl. ..... 327/539

(58) Field of Classification Search ..... 323/313; 327/513, 539

See application file for complete search history.

(56) References Cited

U.S. PATENT DOCUMENTS

| | | | | |
|---|---|---|---|---|
| 6,075,407 | A * | 6/2000 | Doyle | 327/539 |
| 6,160,391 | A * | 12/2000 | Banba | 323/313 |
| 6,452,437 | B1 * | 9/2002 | Takeuchi et al. | 327/513 |
| 6,462,612 | B1 * | 10/2002 | Roh et al. | 327/539 |
| 6,847,240 | B1 * | 1/2005 | Zhou | 327/143 |
| 6,894,555 | B2 * | 5/2005 | Liu | 327/539 |

OTHER PUBLICATIONS

*Kuijk: A Precision Reference voltage Source; IEEE Journal of Solid-State Circuits*, vol. sc-8, No. 3, Jun. 1973; pp. 222-226.

Banba, et al., *Banba, et al. A CMOS Bandgap Reference Circuit with Sub-1-V Operation; IEEE Journal of Solid-State Circuits*, vol. 34, No. 5; May 1999/ pp. 670-674.

* cited by examiner

*Primary Examiner*—Jeffrey Zweizig
(74) *Attorney, Agent, or Firm*—Blakely, Sokoloff, Taylor & Zafman LLP

(57) ABSTRACT

A temperature-independent voltage reference containing two independent bias circuits powered by the reference voltage, each bias circuit containing components with an exponential dependence of current on voltage and one containing a resistive impedance, and further including voltage dividers and an active component.

15 Claims, 7 Drawing Sheets

$V_R$
$R_{1A}$
310
$R_{1B}$
320
$V_1$
$I_1$
$D_1$
380
$R_{1C}$
330
$V_R$
$R_{2A}$
340
$V_3$
$R_{2B}$
350
$R_3$
370
$V_2$
$I_2$
$D_2$
390
$R_{2C}$
360

Thevenin Equivalent Circuits
$\delta V_R$
$R_1$
$V_1$
$I_1$
$D_1$
$\varphi V_R$
$R_2$
$V_3$
$I_2$
$R_3$
$V_2$
$D_1$
$\varepsilon V_1$
$\gamma V_3$
+
−
300
$V_R$ Series Configuration Shunt Configuration

LOW-VOLTAGE, BUFFERED BANDGAP REFERENCE WITH SELECTABLE OUTPUT VOLTAGE

FIELD OF THE INVENTION

Embodiments of the invention relate to temperature independent voltage references. More specifically, embodiments of the invention relate to voltage references that can operate at voltages less than a bandgap voltage.

BACKGROUND

Temperature-independent voltage references are used in many different applications. For example, they can help ensure stability of oscillators, digital-to-analog converters (DACs) and analog-to-digital converters (ADCs), phase-locked loops (PLLs), linear regulators, DC-DC converters, RF circuits, and body-bias generators. Many prior-art voltage reference designs rely on a combination of elements with differing temperature characteristics. The combination typically results in a reference voltage equal to the semiconductor bandgap voltage (approximately 1.2V for silicon). This voltage can be multiplied to produce higher-valued references.

As microelectronic circuit processing techniques and material purities improve, smaller and more power-efficient circuits can be constructed. However, these smaller circuits often have correspondingly smaller process maximum voltages ("$V_{max}$")—that is, voltages above which the circuit elements will be damaged. In some circuits, the process maximum voltage can be less than the semiconductor bandgap voltage (approximately 1.2V for silicon). Voltage references that can produce a stable, temperature-independent reference of less than the semiconductor bandgap voltage may be useful in combination with these circuits.

FIG. 1 shows a prior-art voltage reference as taught in *A Precision Reference Voltage Source* by Karel E. Kuijk (IEEE Journal of Solid State Circuits, Vol. SC-8, No. 3, June 1973). Current $I_1$ through diode 110 and current $I_2$ through diode 120 and resistor 130 produce voltages $V_1$ and $V_2$, respectively; op-amp 140 produces a feedback signal $V_R$ that is largely independent of temperature, and substantially equal to the semiconductor bandgap voltage of about 1.2V for silicon. Diodes 110 and 120 may be implemented as the base-emitter junctions of bipolar transistors.

FIG. 2 shows another prior-art voltage reference as taught in *A CMOS Bandgap Reference Circuit with Sub-1-V Operation* by Hironori Banba et al. (IEEE Journal of Solid-State Circuits, Vol. 34, No. 5, May 1999). This circuit can produce an arbitrarily low reference by adjusting resistor 240, but it has several drawbacks compared to Kuijk's reference. First, it requires three matched current sources (MOSFETs 210, 220 and 230) that, in the deep submicron technologies of modem circuits, are difficult to manufacture due to gate leakage and threshold voltage variation. Second, even if three identical MOSFETs could be made, drain-source voltages across the devices are not equal over a wide temperature range. This causes current mismatch due to a finite drain output impedance. These difficulties can cause a reference variation of as much as 1%. Third, the output of the circuit cannot be loaded—drawing even a small current from the reference at 250 will change the voltage. Fourth, the circuit cannot be used in a shunt configuration (explained below) because it requires a supply voltage 260 that is larger than $V_R$.

BRIEF DESCRIPTION OF DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

DETAILED DESCRIPTION

Figure 3:
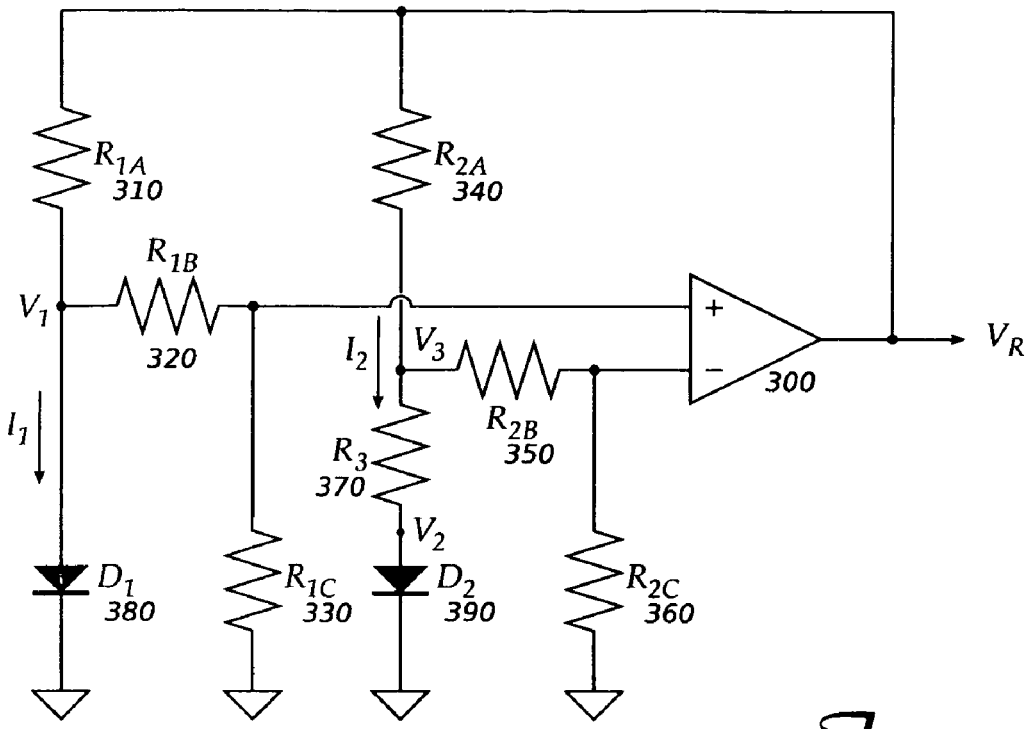
FIG. 3 is a temperature-independent voltage reference according to an embodiment of the invention.

FIG. 3 shows the general form of a circuit according to an embodiment of the invention. The circuit can be used as a precision voltage reference and can operate from a supply voltage below 1.2V, or above 1.2V as long as the maximum voltage rating on the devices is not exceeded. In fact, the supply voltage can be as low as one forward diode voltage, which is about 0.8V for a silicon diode, but can be much lower for a Schottky diode or diodes manufactured from materials other than silicon. The circuit of FIG. 3 is analyzed in the following paragraphs.

The circuit uses one operational amplifier 300, up to seven resistors ($R_{1A}$ 310, $R_{1B}$ 320, $R_{1C}$ 330, $R_{2A}$ 340, $R_{2B}$ 350, $R_{2C}$ 360, $R_3$ 370), and two components with an exponential dependency of current on voltage ("exponential I(V) characteristic"), shown as diodes $D_1$ 380 and $D_2$ 390. Resistors $R_{1A}$ 310, $R_{1B}$ 320 and $R_{1C}$ 330 operate to bias diode $D_1$ 380 at a first point of its range, while resistors $R_{2A}$ 340, $R_{2B}$ 350, $R_{2C}$ 360 and $R_3$ 370 bias diode $D_2$ 390 at a second point of its range. Resistors $R_{1B}$ 320 and $R_{1C}$ 330 form a voltage divider to produce a voltage proportional to $V_1$, the voltage across $D_1$. Resistors $R_{2B}$ 350 and $R_{2C}$ 360 form a voltage divider to produce a voltage proportional to $V_3$, the voltage across $D_2$ and $R_3$. The op amp 300 is an active component that compares the voltages of the two voltage dividers and produces an output signal that, because of the feedback loop in the circuit, is a temperature-independent reference voltage whose value is set according to the selection of the resistors. As shown in FIG. 3, the two bias circuits are each powered by the reference voltage, and operate independently of each other, since no path exists for current to flow from one to the other. In various embodiments, diodes $D_1$ and $D_2$ may be implemented as actual P-N junction diodes, as the base-emitter junction of a bipolar transistor, or as another component with an exponential I(V) characteristic. The generic term "diode" will be used to refer to these circuit elements. In some embodiments, a "string" of several diodes or base-emitter junctions may be formed in series, instead of a single diode or transistor.

The circuit operates on the principle that if two diodes are biased at different current densities with a constant ratio, then the difference between voltages across the two diodes is proportional to absolute temperature ("PTAT"). If the current densities are also PTAT, then the forward voltage across each diode is inversely proportional to absolute temperature ("IPTAT"). A properly-selected, weighted sum of the IPTAT diode voltage and the PTAT difference of diode voltages has a zero temperature coefficient (ZTC) to the first order. Such a weighted sum is known to be substantially equal to the bandgap voltage $V_G$, but if additional degrees of freedom are provided (by, for example, the voltage dividers containing resistors $R_{1B}$ 320 and $R_{1C}$ 330, and $R_{2B}$ 350 and $R_{2C}$ 360) the weighted sum can be adjusted to a desired value, not necessarily equal to the bandgap voltage, by adjusting the ratios between voltage-divider resistors. The adjusted, weighted sum retains its temperature independence, and, since it is produced as a feedback signal from op amp 300 (which compares scaled voltages proportional to $V_1$ and $V_3$), it is a low-impedance source that can be loaded without ill effects.

Figure 4:
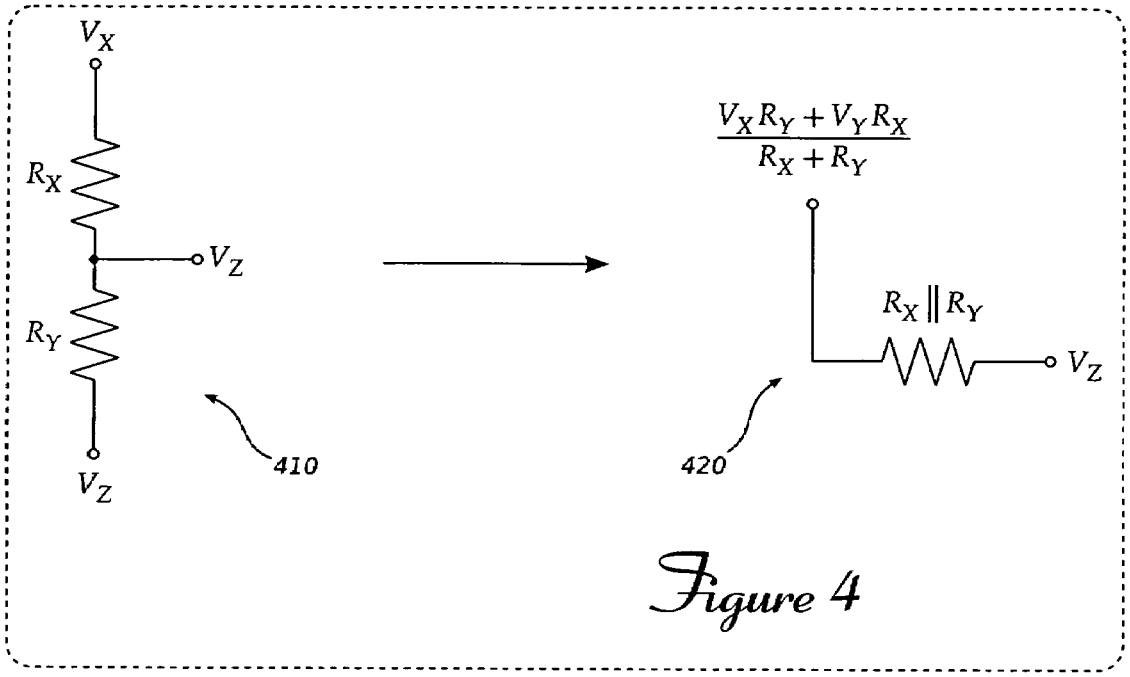
FIG. 4 illustrates the conversion of a circuit into its Thevenin equivalent.

A simplified Thevenin-equivalent of the circuit shown in FIG. 3 is useful in deriving a quantitative description of that circuit's operation. FIG. 4 provides a simple illustration of a Thevenin equivalent. Resistive voltage divider $R_X$, $R_Y$ is connected between voltage potentials $V_X$ and $V_Y$ at element 410. According to Thevenin's theorem, the divider can be replaced by a voltage source and output impedance satisfying the following equation:

$$I_Z = \frac{V_X - V_Z}{R_X} + \frac{V_Y - V_Z}{R_Y} = \frac{\frac{V_X R_Y + V_Y R_X}{R_X + R_Y} - V_Z}{\frac{R_X R_Y}{R_X + R_Y}} = \frac{\frac{V_X R_Y + V_Y R_X}{R_X + R_Y} - V_Z}{R_X \parallel R_Y} \tag{1}$$

The Thevenin equivalent voltage source and output impedance are shown as element 420.

Figure 5:
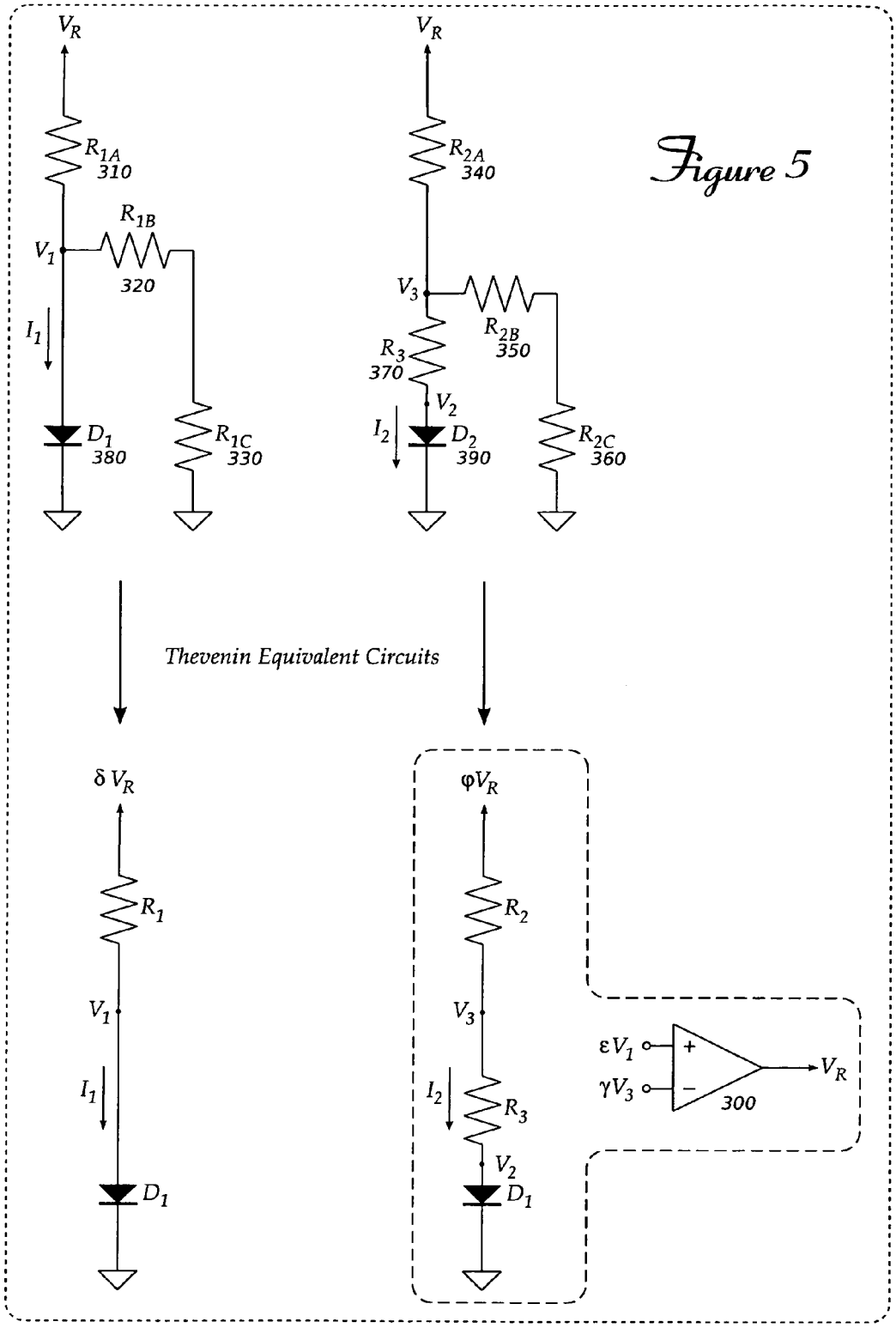
FIG. 5 shows the two independent bias circuits of an embodiment of the invention and their Thevenin equivalent circuits.

Since resistors $R_{1A}$ and ($R_{1B}$+$R_{1C}$) form a voltage divider with output $V_1$, and resistors $R_{2A}$ and ($R_{2B}$+$R_{2C}$) form a voltage divider with output $V_3$, these can be replaced with their equivalent circuits as shown in FIG. 5. In making the transformation, amplifier inputs are assumed not to load the $R_{1B}$+$R_{1C}$ and $R_{2B}$+$R_{2C}$ legs of the voltage dividers, and the following definitions are used to simplify the equations:

$$R_1 = R_{1A} \parallel (R_{1B} + R_{1C}) = \frac{R_{1A} * (R_{1B} + R_{1C})}{R_{1A} + R_{1B} + R_{1C}} \tag{2}$$

$$R_2 = R_{2A} \parallel (R_{2B} + R_{2C}) = \frac{R_{2A} * (R_{2B} + R_{2C})}{R_{2A} + R_{2B} + R_{2C}} \tag{3}$$

$$\alpha = \frac{R_{1B} + R_{1C}}{R_{1A} + R_{1B} + R_{1C}} \tag{4}$$

$$\beta = \frac{R_{1C}}{R_{1B} + R_{1C}} \tag{5}$$

$$\gamma = \frac{R_{2B} + R_{2C}}{R_{2A} + R_{2B} + R_{2C}} \tag{6}$$

$$\delta = \frac{R_{2C}}{R_{2B} + R_{2C}} \tag{7}$$

With the help of these definitions and the Thevenin-equivalent circuits shown in FIG. 5, conditions can be derived for resistor values that will guarantee proper operation of the circuit in FIG. 3.

If we define $$V_T = \frac{nkT}{q} \tag{8}$$

where n is the ideality factor of a diode (n=1 for an ideal diode, but is somewhat larger than 1 for actual diodes), then current through diode $D_1$ is given by $$I_1 = I_{S1} * \exp\left(\frac{V_1}{V_T}\right) = I_{O1} * \exp\left(\frac{-V_G}{V_T}\right) * \exp\left(\frac{V_1}{V_T}\right) \tag{9}$$

$$I_{O1} = A_1 * D * T^{\eta} \tag{10}$$

where $A_1$ is the area of diode $D_1$, $V_G$ is the bandgap voltage, and D and η are process-dependent constants. Similarly we can write for the current through diode $D_2$:

$$I_2 = I_{S2} * \exp\left(\frac{V_2}{V_T}\right) = I_{O2} * \exp\left(\frac{-V_G}{V_T}\right) * \exp\left(\frac{V_2}{V_T}\right) \tag{11}$$

$$I_{O2} = A_2 * D * T^{\eta} \tag{12}$$

$$A_2 = N * A_1 \tag{13}$$

From the diode current equations above we can write voltages $V_1$ and $V_2$ as:

$$V_1 = V_G + V_T \ln\left(\frac{I_1}{I_{O1}}\right) \tag{14}$$

$$V_2 = V_G + V_T \ln\left(\frac{I_2}{I_{O2}}\right) \tag{15}$$

and the difference between these voltages as:

$$V_1 - V_2 = V_T \ln\left(\frac{I_{O2}}{I_{O1}} * \frac{I_1}{I_2}\right) \tag{16}$$

From Ohm's law, we can calculate currents $I_1$ and $I_2$:

$$I_1 = \frac{\alpha * V_R - V_1}{R_1} \tag{17}$$

$$I_2 = \frac{\gamma * V_R - V_3}{R_2} \tag{18}$$

and write their ratio as:

$$\frac{I_1}{I_2} = \frac{R_2}{R_1} * \frac{\alpha * V_R - V_1}{\gamma * V_R - V_3} \tag{19}$$

Because of the feedback loop, the amplifier operates to keep $$\beta * V_1 = \delta * V_3 \tag{20}$$

so we can write:

$$\frac{I_1}{I_2} = \frac{R_2}{R_1} * \frac{\delta}{\beta} \frac{\alpha * V_R - V_1}{\gamma \frac{\delta}{\beta} * V_R - V_1} \tag{21}$$

To remove the temperature- and voltage-dependency of the ratio of $I_1$ and $I_2$, we set $$\alpha = \gamma \frac{\delta}{\beta} \tag{22}$$

which gives:

$$\frac{I_1}{I_2} = \frac{R_2}{R_1} * \frac{\delta}{\beta} = \frac{R_2}{R_1} * \frac{\alpha}{\gamma}. \tag{23}$$

From the definitions of $I_{O1}$ and $I_{O2}$, we obtain $$\frac{I_{O2}}{I_{O1}} = \frac{A_2}{A_1} = N \tag{24}$$

After substitution for ratios of currents, we obtain for the diode voltage difference $$V_1 - V_2 = V_T \ln\left(\frac{I_{O2}}{I_{O1}} * \frac{I_1}{I_2}\right) = V_T * \ln\left(N * \frac{R_2}{R_1} * \frac{\alpha}{\gamma}\right) \tag{25}$$

From Ohm's law, $$I_2 = \frac{V_3 - V_2}{R_3} = \frac{\frac{\beta}{\delta} * V_1 - V_2}{R_3} = \frac{\frac{\gamma}{\alpha} * V_1 - V_2}{R_3} \tag{26}$$

Then, $$\alpha * V_R = V_1 + R_1 * I_1 = V_1 + R_1 * \frac{R_2}{R_1} * \frac{\alpha}{\gamma} * I_2 = V_1 + R_2 * \frac{\alpha}{\gamma} * I_2 \tag{27}$$

$$\alpha * V_R = V_1 + R_2 * \frac{\alpha}{\gamma} * \frac{\frac{\gamma}{\alpha} * V_1 - V_2}{R_3} \tag{28}$$

$$\alpha * V_R = V_1 * \left[1 + \frac{R_2}{R_3} * \left(1 - \frac{\alpha}{\gamma}\right)\right] + \frac{R_2}{R_3} * \frac{\alpha}{\gamma} * (V_1 - V_2) \tag{29}$$

and $$V_R = V_1 * \left[\frac{1}{\alpha} + \frac{R_2}{R_3} * \left(\frac{1}{\alpha} - \frac{1}{\gamma}\right)\right] + \frac{R_2}{R_3} * \frac{1}{\gamma} * (V_1 - V_2). \tag{30}$$

After substituting for $V_1 - V_2$ into $V_R$, we obtain $$V_R = \begin{array}{l} V_1 * \left[\frac{1}{\alpha} + \frac{R_2}{R_3} * \left(\frac{1}{\alpha} - \frac{1}{\gamma}\right)\right] + \\ V_T * \frac{R_2}{R_3} * \frac{1}{\gamma} * \ln\left(N * \frac{R_2}{R_1} * \frac{\alpha}{\gamma}\right) \end{array} \tag{31}$$

Continuing, we define constants $$K = \frac{1}{\alpha} + \frac{R_2}{R_3} * \left(\frac{1}{\alpha} - \frac{1}{\gamma}\right) \tag{32}$$

$$L = \frac{R_2}{R_3} * \frac{1}{\gamma} * \ln\left(N * \frac{R_2}{R_1} * \frac{\alpha}{\gamma}\right) \tag{33}$$

and $$H = \frac{L}{K} \tag{34}$$

Then:

$$V_R = K * V_1 + L * V_T = K * (V_1 + V_T * H) \tag{35}$$

Note that K, L, and H do not depend on temperature because they are only functions of resistor ratios. If a sum of a forward diode voltage and a voltage PTAT exhibits ZTC, then this sum is substantially equal to the bandgap voltage $V_G$. According to the last equation, ZTC can be achieved by a proper selection of resistor values and diode ratios that enter into H. In addition, the reference voltage $V_R$ is substantially equal to $K * V_G$. Depending on the value of K, the reference voltage can be lower than, equal to, or larger than the bandgap voltage $V_G$.

With this complete analysis of the circuit of FIG. 3 in hand, we consider several embodiments of the circuit, characterized by the values of α, β, γ and δ, which in turn depend upon the values of $R_{1A}$, $R_{1B}$, $R_{1C}$, $R_{2A}$, $R_{2B}$ and $R_{2C}$ as specified in the definitions above.

Figure 1:
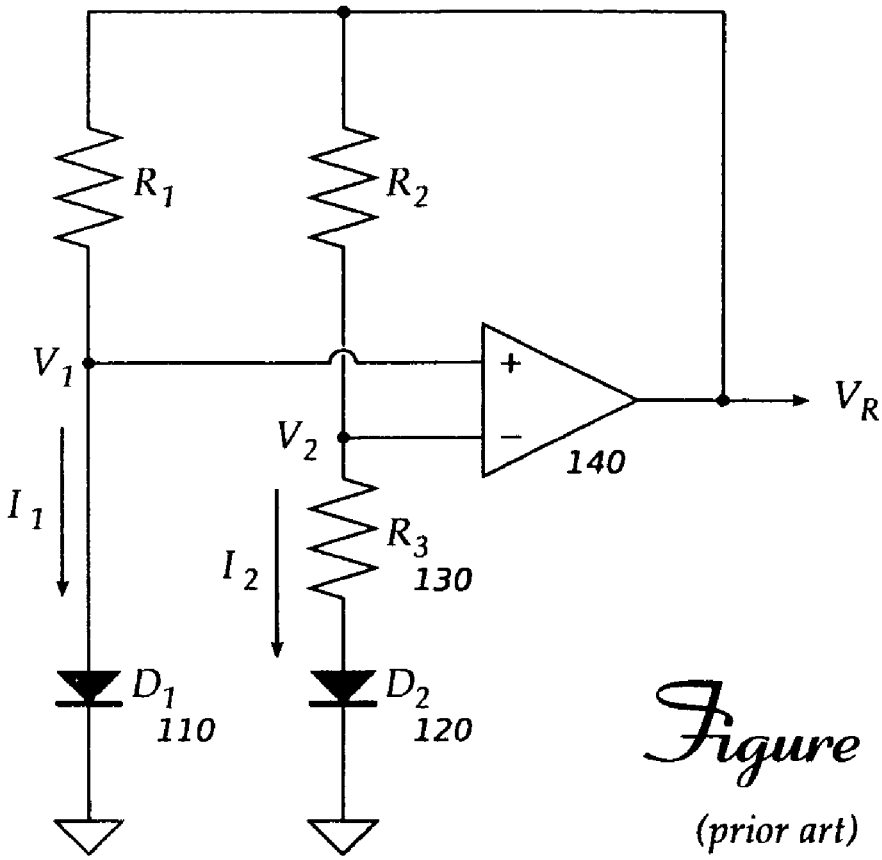
Figure 1 (prior art)
FIGS. 1 and 2 are prior-art temperature-independent voltage references.

It is interesting to note that if α=β=γ=δ=1, then the equations above describe Kuijk's circuit as shown in FIG. 1. The tapped dividers $R_{1B}$, $R_{1C}$ and $R_{2B}$, $R_{2C}$ can be eliminated so that $R_1 = R_{1A}$ and $R_2 = R_{2A}$. The reference voltage is given by $$V_R = V_1 + V_T * \frac{R_2}{R_3} * \ln\left(N * \frac{R_2}{R_1}\right) \tag{36}$$

The condition for ZTC is $$0 = \ln\left(\frac{I_{1R}}{I_{O1R}}\right) + 1 - \eta - \vartheta + H \tag{37}$$

where $$H = \frac{R_2}{R_3} * \ln\left(N * \frac{R_2}{R_1}\right) \tag{38}$$

This leads to a second-order temperature dependency $$V_R = V_G + V_T * \left[(\eta - 1) * \left(1 - \ln\left(\frac{T}{T_R}\right)\right) + \vartheta - \ln\left(\frac{R_1}{R_{1R}}\right)\right] \tag{39}$$

so the nominal reference voltage is substantially equal to the bandgap voltage. This provides a useful check of the correctness of the preceding derivation of circuit equations.

In an embodiment of the invention, $0<\alpha=\gamma<1$ and $0<\beta=\delta\cdot 1$. To obtain the lowest sensitivity to the amplifier offset, one should set $\beta=\delta=1$. In this case, divider taps for the amplifier inputs are not needed; $R_{1B}$ and $R_{1C}$, and $R_{2B}$ and $R_{2C}$, can be combined. In other cases it may be desirable to lower the common mode voltage of the amplifier inputs. In those cases, values for $\beta$ and $\delta$ less than 1 can be used despite the resulting increased offset sensitivity.

The reference voltage for this embodiment is given by $$V_R = \frac{1}{\alpha} * \left[V_1 + V_T * \frac{R_2}{R_3} * \ln\left(N * \frac{R_2}{R_1}\right)\right] \tag{40}$$

The condition for ZTC is $$0 = \ln\left(\frac{I_{IR}}{I_{OIR}}\right) + 1 - \eta - \vartheta + H \tag{41}$$

where $$H = \frac{R_2}{R_3} * \ln\left(N * \frac{R_2}{R_1}\right) \tag{42}$$

This leads to the second-order temperature dependency $$V_R = \frac{1}{\alpha} * \left\{V_G + V_T * \left[(\eta - 1) * \left(1 - \ln\left(\frac{T}{T_R}\right)\right) + \vartheta - \ln\left(\frac{R_1}{R_{1R}}\right)\right]\right\} \tag{43}$$

Because $0<\alpha<1$, the nominal reference voltage in the second embodiment can be substantially larger than the bandgap voltage.

In another embodiment, $0<\gamma<\alpha<1$, $0<\delta\leqq 1$, and $\beta=\delta*\gamma/\alpha$. Again, offset sensitivity can be minimized if $\delta=1$, although values of $\delta<1$ can lower the common mode voltage. The reference voltage of this embodiment is given by $$V_R = K * V_1 + L * V_T = K * (V_1 + V_T * H) \tag{44}$$

where $$K = \frac{1}{\alpha} * \left[1 + \frac{R_2}{R_3} * \left(1 - \frac{\alpha}{\gamma}\right)\right] \tag{45}$$

$$L = \frac{1}{\alpha} * \frac{R_2}{R_3} * \frac{\alpha}{\gamma} * \ln\left(N * \frac{R_2}{R_1} * \frac{\alpha}{\gamma}\right) \tag{46}$$

and $$H = \frac{L}{K} \tag{47}$$

For properly selected values of $\alpha$, $\beta$, $\gamma$ and $\delta$, we can obtain $K<1$. Constants K and L contain four independent parameters: $1/\alpha$, $\alpha/\gamma$, $R_2/R_3$ and $N*R_2/R_1$. The latter parameter determines the sensitivity of the bandgap core and should be as large as practically achievable. The maximum value is usually limited by the diode I-V characteristic to less than about 100. The remaining three parameters can be chosen to satisfy two conditions: the desired value of the reference voltage $V_R$ and ZTC. This leaves freedom to arbitrarily choose one of the three parameters.

It turns out that the residual temperature dependency (after achieving ZTC at the desired temperature $T_R$) is smallest when $\alpha$ is close to 1. If the values of resistors $R_{1B}$ and $R_{1C}$ are much larger than the value of $R_{1A}$, they may be costly to implement and the resistor ratios may be difficult to match. Without too much degradation in temperature sensitivity, it may be more practical to choose a between about 0.9 and 0.95. Then parameters $\alpha/\gamma$, $R_2/R_3$ can be found as solutions of a system of two equations: one for the desired $K<1$ and the other for the ZTC condition.

Because $0<K<1$, the nominal reference voltage can be substantially lower than the bandgap voltage.

Figure 2:
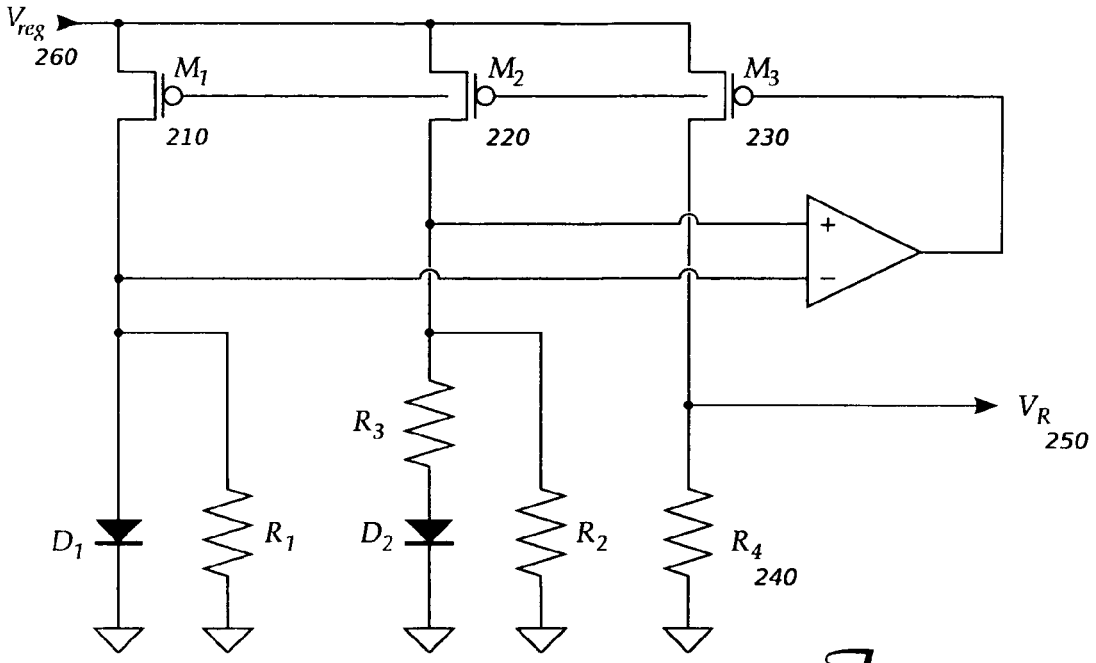
Figure 2 (prior art)

By way of comparison with the prior art circuits shown in FIGS. 1 and 2, embodiments of the current invention can generate arbitrary reference voltages, both larger and smaller than the bandgap voltage. Kuijk's circuit can only produce a reference equal to the bandgap voltage. Banba's circuit can produce an arbitrary reference voltage, but the reference cannot supply any current, and the circuit requires a regulated voltage larger than the reference voltage to operate. Also, Banba requires matched transistors, which are difficult to fabricate. Embodiments of the current invention require no matching of transistors beyond that required for a low-offset operational amplifier (a requirement common to all the circuits).

Figure 6A:
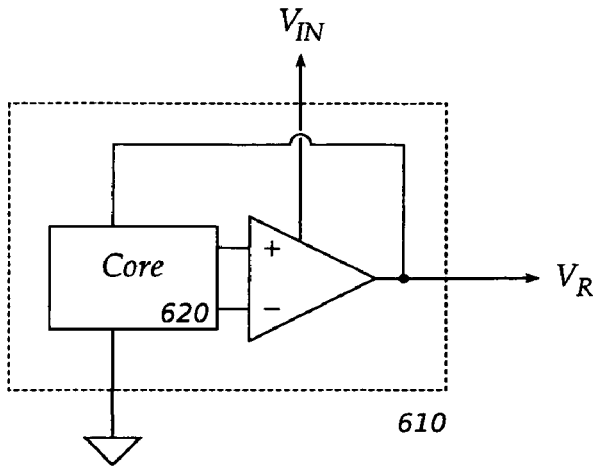
FIGS. 6A and 6B show embodiments of the invention connected in series and shunt configurations, respectively.
Figure 6B:
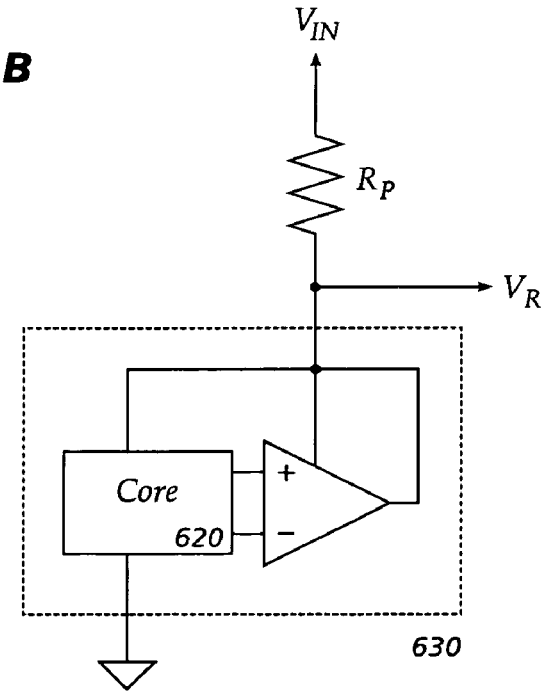

Embodiments of the current invention can be used in the configurations shown in FIGS. 6A and 6B. FIG. 6A, element 610 shows the circuit in a series configuration ("core" 620 represents the diode and resistor network shown in FIG. 3). In series mode, $V_{in}$ powers the amplifier only; the core is powered from the reference-voltage output of the amplifier. Since the reference voltage appears at the output of an amplifier, it can be loaded and/or drive other circuits without affecting the reference's stability.

FIG. 6B, element 620 shows the circuit in a shunt configuration. This two-terminal circuit can be powered by any voltage $V_{in}$ greater than $V_R$; any excess voltage appears across the pull-up resistor $R_P$. In particular, when the amplifier is powered from $V_R$ itself, as shown, it is possible to safely operate the circuit from a voltage larger than the maximum process voltage ($V_{max}$). For a CMOS technology, $V_{max}$ is given by hot carrier degradation, oxide breakdown and tunneling, or the maximum reverse diode voltage. Safe operation at elevated voltage $V_{in}$ is possible because in a shunt configuration, the output reference voltage $V_R$ is also the maximum voltage applied to the components of the reference circuit. The circuit will operate reliably as long as the reference voltage is set to a value less than or equal to $V_{max}$, and (as discussed earlier) $V_{max}$ can be less than $V_G$.

A further application of the circuit capitalizes on the fact that the voltage across resistor $R_3$ is proportional to the absolute temperature. Because of this property, the circuit can also be used as a self-biased linear temperature sensor, with the voltage across resistor $R_3$ providing the linear temperature signal.

Figure 7A:
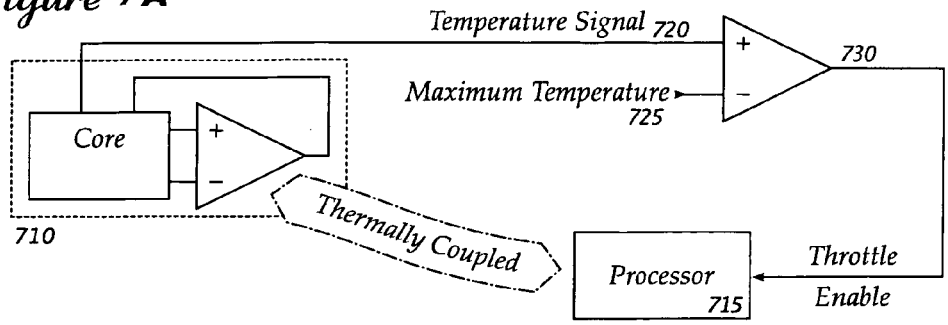
FIGS. 7A, 7B, 7C and 7D show block diagrams of four broader systems that can benefit from an embodiment of the invention.

FIG. 7A, element 710 shows an embodiment of the invention operating as a temperature sensor. Such a sensor may be fabricated on or near a substrate containing another circuit such as a digital processor 715 (e.g. a programmable processor or a digital signal processor) so that it is thermally coupled with the processor. The temperature sensor can be used to monitor the temperature of the digital processor, providing a temperature signal 720 that can be compared with a maximum temperature 725 by a device such as comparator 730, and may trigger a throttling mechanism such as a clock divider if the processor's temperature exceeds a safe value. In this application, an embodiment of the invention can help prevent thermal damage to a processor operating in a hostile environment (high ambient temperature, inadequate cooling, excess supply voltage, sustained duty cycle, etc.)

Figure 7B:
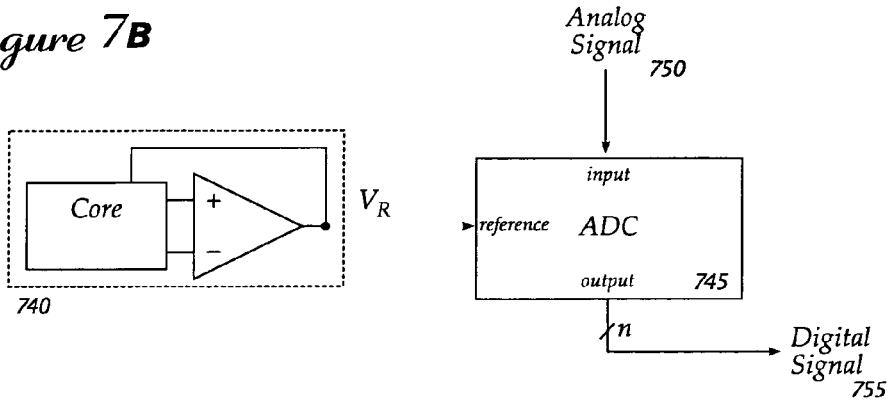

FIG. 7B, element 740 shows an embodiment of the invention used as a temperature-independent voltage reference, with its output signal providing a reference value for analog-to-digital converter ("ADC") 745. ADCs can convert an analog input signal 750 at the converter's input into a digital value such as n-bit digital signal 755 presented at the converter's output. A reference input supplied by a temperature-independent voltage reference, permits the digital value to be calibrated to a known absolute voltage value. In a complementary application, an embodiment of the invention 760 can provide a reference value for use by a digital-to-analog converter ("DAC") 765. A DAC can convert a digital value (for example, an n-bit binary number 770) into an analog voltage or current such as analog signal 775. By incorporating a stable reference voltage from an embodiment of the invention, the DAC system can produce an analog signal that is calibrated to a known absolute voltage.

Figure 7C:
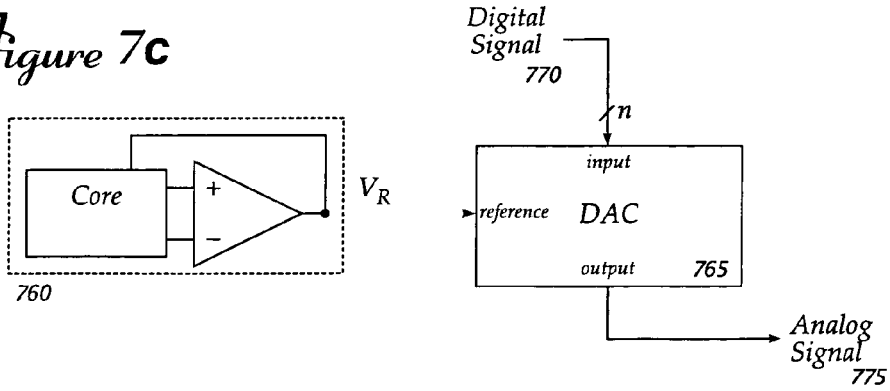
Figure 7D:
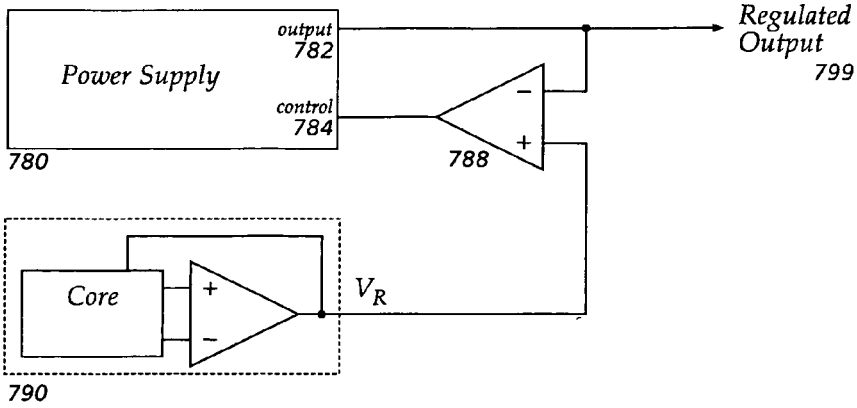

Embodiments of the invention may also find applications in regulated power supplies. For example, as shown in FIG. 7C, power supply 780 provides current from its output 782. Control input 784 may be used to adjust the voltage at output 782. An embodiment of the invention shown in FIG. 7D as element 790 can supply a temperature independent reference voltage $V_R$ to comparator 788, which compares the reference voltage to the output voltage and produces an appropriate feedback signal to cause the output voltage to match the reference voltage. This feedback loop regulates the output voltage to produce regulated output 799.

The embodiments of the present invention have been described largely in terms of specific proportional relationships between the values of certain components. However, those of skill in the art will recognize that other proportional relationships can produce temperature-insensitive voltage references and self-biased linear temperature sensors with other characteristics. Such variations are understood to be apprehended according to the following claims.

We claim:

1. An apparatus comprising:

a first bias circuit to bias a first component with an exponential dependency of current on voltage ("exponential I(V) characteristic") at a first point of its range;

a second, independent bias circuit to bias a second component with an exponential I(V) characteristic at a second point of its range, the first point being different than the second point;

a resistive impedance in series with the second component;

a first voltage divider to produce a first voltage proportional to a voltage across the first component;

a second voltage divider to produce a second voltage proportional to a sum of a voltage across the second component and a voltage across the resistive impedance; and an active component to compare the first voltage and the second voltage and to produce a reference voltage; wherein in operation a current through each voltage divider is greater than zero, and the bias circuits are powered by the reference voltage.

2. The apparatus of claim 1 wherein the first and second components are diodes.

3. The apparatus of claim 1 wherein the first and second components are bipolar transistors.

4. The apparatus of claim 1 wherein the first bias circuit comprises a first resistor in series with the first component and the second bias circuit comprises a second resistor in series with the second component and the resistive impedance.

5. The apparatus of claim 4 wherein the first voltage divider comprises a first divider resistor in series with a second divider resistor; and the second voltage divider comprises a third divider resistor in series with a fourth divider resistor.

6. The apparatus of claim 5 wherein:

$\alpha$ is a ratio between a sum of the first divider resistor and the second divider resistor; and a sum of the first resistor, the first divider resistor and the second divider resistor;

$\beta$ is a ratio between the second divider resistor and a sum of the first divider resistor and the second divider resistor;

$\gamma$ is a ratio between a sum of the third divider resistor and the fourth divider resistor; and a sum of the second resistor, the third divider resistor and the fourth divider resistor; and $\delta$ is a ratio between the third divider resistor and a sum of the third divider resistor and the fourth divider resistor; where $$0<\alpha=\gamma<1 \text{ and } 0<\beta=\delta\leq 1.$$

7. The apparatus of claim 5 wherein:

$\alpha$ is a ratio between a sum of the first divider resistor and the second divider resistor; and a sum of the first resistor, the first divider resistor and the second divider resistor;

$\beta$ is a ratio between the second divider resistor and a sum of the first divider resistor and the second divider resistor;

$\gamma$ is a ratio between a sum of the third divider resistor and the fourth divider resistor; and a sum of the second resistor, the third divider resistor and the fourth divider resistor; and $\delta$ is a ratio between the third divider resistor and a sum of the third divider resistor and the fourth divider resistor; where $$0<\gamma<\alpha<1; \text{ and } \beta=\delta*\gamma/\alpha.$$

8. The apparatus of claim 1 wherein the reference voltage is not equal to a bandgap voltage.

9. The apparatus of claim 1 wherein the reference voltage is less than a bandgap voltage.

10. The apparatus of claim 1 wherein the reference voltage is greater than a bandgap voltage.

11. The apparatus of claim 5 wherein:

$\alpha$ is a ratio between a sum of the first divider resistor and the second divider resistor; and a sum of the first resistor, the first divider resistor and the second divider resistor;

$\gamma$ is a ratio between a sum of the third divider resistor and the fourth divider resistor; and a sum of the second resistor, the third divider resistor and the fourth divider resistor;

R2 is a Thevenin equivalent resistance of the second bias circuit and the second voltage divider;

R3 is a resistance of the resistive impedance in series with the second component; and $$K \text{ is } \frac{1}{\alpha} + \frac{R_2}{R_3} * \left(\frac{1}{\alpha} - \frac{1}{\gamma}\right);$$

the reference voltage being substantially equal to a product of K and a bandgap voltage.

12. The apparatus of claim 1 wherein a maximum permissible voltage for the active component does not exceed a bandgap voltage.

13. The apparatus of claim 1 wherein:

a maximum permissible voltage for the active component exceeds a bandgap voltage; and the reference voltage is less than the bandgap voltage.

14. The apparatus of claim 1 wherein the reference voltage is less than 1.2 volts.

15. The apparatus of claim 8 wherein the first component with an exponential I(V) characteristic is formed upon a silicon substrate.

* * * * *

UNITED STATES PATENT AND TRADEMARK OFFICE

CERTIFICATE OF CORRECTION

PATENT NO. : 7,274,250 B2
APPLICATION NO. : 11/170559
DATED : September 25, 2007
INVENTOR(S) : Hazucha et al.

It is certified that error appears in the above-identified patent and that said Letters Patent is hereby corrected as shown below:

In column 1, at line 56, delete “modem” and insert --modern--.

Signed and Sealed this

Second Day of September, 2008

JON W. DUDAS
*Director of the United States Patent and Trademark Office*